US009314103B1

(12) United States Patent
Lakkios

(10) Patent No.: US 9,314,103 B1
(45) Date of Patent: Apr. 19, 2016

(54) SLING-BACK CHAIR

(71) Applicant: Maria G. Lakkios, Tampa, FL (US)

(72) Inventor: Maria G. Lakkios, Tampa, FL (US)

(73) Assignee: University of South Florida, Tampa, FL (US)

( * ) Notice: Subject to any disclaimer, the term of this patent is extended or adjusted under 35 U.S.C. 154(b) by 264 days.

(21) Appl. No.: 14/027,359

(22) Filed: Sep. 16, 2013

(51) Int. Cl.
*A47C 7/02* (2006.01)
*A47C 7/50* (2006.01)
*A47C 7/54* (2006.01)

(52) U.S. Cl.
CPC ... *A47C 7/02* (2013.01); *A47C 7/50* (2013.01); *A47C 7/54* (2013.01)

(58) Field of Classification Search
CPC ..... A47C 4/03; A47C 7/282; A47C 23/18; A47C 4/024
USPC ..... 297/440.11, 440.15
See application file for complete search history.

(56) References Cited

U.S. PATENT DOCUMENTS

| | | | | | |
|---|---|---|---|---|---|
| 2,417,439 | A | | 3/1947 | Overdick | |
| D199,621 | S | * | 11/1964 | Johnson | D6/374 |
| 3,643,997 | A | * | 2/1972 | Gilbert et al. | 297/440.11 |
| 3,680,916 | A | * | 8/1972 | Gilbert et al. | 297/440.11 |
| 3,752,533 | A | * | 8/1973 | Gilbert | A47C 1/02 297/440.11 |
| 4,146,269 | A | * | 3/1979 | Beckley | 297/440.18 |
| 5,652,982 | A | | 8/1997 | Kiefer et al. | |
| 5,911,478 | A | | 6/1999 | Goodman | |
| 7,240,961 | B2 | | 7/2007 | Grace | |

* cited by examiner

*Primary Examiner* — Sarah McPartlin
(74) *Attorney, Agent, or Firm* — Nicholas Pfeifer; Smith & Hopen, P.A.

(57) ABSTRACT

The Sling-Back Chair is a new hammock hybrid chair. The chair is a cross between a lounge style chair and a hammock. The chair can be optioned for interior or exterior, with personalization options like style, materials and fabrics, armrests, foot stools, etc. The Sling-Back Chair keeps the essential and good qualities of a hammock, and merges them with a wood style lounge chair. The design is minimalist inspired, and is easily assembled with only 6 furniture hardware bolts and nuts. The design consists of a frame with a sling extending between two ends of the frame. This results in a storage area between the sling and the chair frame. The sling can be made adjustable to provide a firm or looser feel and the sling is attached with dowels allowing it to be easily attached, removed, or replaced.

19 Claims, 6 Drawing Sheets

SLING-BACK CHAIR

BACKGROUND OF THE INVENTION

1. Field of the Invention

This invention relates to chairs. More specifically, it relates to an improved sling back chair design.

2. Brief Description of the Related Art

This chair design is a cross between a hammock and a chair. Hammocks can be uncomfortable when lying for long periods of time. The problem with hammocks is that they do not capture the natural contours and curves of the human body. There have been attempts to design a sling chair to capture the natural contours and curves of the human body, but most require a pillow for proper neck support.

Another problem commonly associate with sling chairs is the limited lifespan of the sling. A sling is typically made of a flexible material, which is inherently susceptible to stretching, tearing, and deterioration. Sling chairs are especially vulnerable when left outside and the sling is exposed to the weather. Replacing the sling can be a difficult time consuming process resulting in most owner's purchasing a new chair.

There exists a need for an improved sling chair design that captures all the natural joints of a human body while also providing for easy assembly and replacement of the sling.

However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for an improved sling chair design is now met by a new, useful, and nonobvious invention.

The present invention is an improved sling back chair design that captures all the natural joints of a human body finding the appropriate comfortable middle point between a hammock and a chair. The sling back chair also provides for easy assembly and replacement of the sling by allowing the sling to pass through the frame and be secured on the outside face of the frame, without being affixed to the frame.

The present invention is a sling back chair having a chair frame with a head end and a seat end and a sling extending between the head end and seat end of the chair frame. The sling has a length and a width, a first end, and a second end. The first end is secured at the head end of the chair frame and the second end is secured at the seat end of the chair frame. The extension of the sling from the head end of the chair frame to the seat end of the chair frame creates a sitting area.

The head end has at least one slit disposed in the surface of the chair frame facing the sitting area. The slit extends through the chair frame to the surface facing away from the sitting area and is capable of allowing a portion of the sling to pass through and protrude out of the surface of the chair frame opposite the sitting area. The seat end also has at least one slit disposed in the surface of the frame facing the sitting area that extends through the chair frame to the surface of the chair frame facing away from the sitting area and allows for passage of a portion of the sling. In a certain embodiment, a portion of the head end is concave towards the sitting area, which contains the slits for the head end of the chair frame.

The portions of the sling protruding from the surface of the chair frame facing away from the sitting area can be secured on the side of the chair frame opposite the sitting area without being affixed to the chair frame. In one embodiment, the ends of the sling have eyeholes that allow for insertion of a dowel.

The dowel is inserted in the eyeholes when protruding from the surface of the chair frame facing away from the sitting area. This secures the sling without the sling or dowel being affixed to the chair frame.

In one embodiment the chair frame may be composed of a seat frame and a back frame. Where the seat frame has a generally horizontal configuration and the back frame has a generally upstanding configuration. The seat frame has a proximal end and a distal end. The distal end being the seat end and a point of contact with the ground, and the proximal end connecting to the back frame. The back frame has a top end and a bottom. The top end being the head end and the bottom end being another point of contact with the ground. In a certain embodiment, the shape of the seat frame is similar to the shape of the back frame to allow the frames to nest together when not attached to each other. In another embodiment, the seat and back frames may have identical shapes.

The frame has a substantially solid surface, excluding the slits, to allow for the slit design. In a certain embodiment, the chair frame has a solid surface below the sling, and the length of the sling is long enough to be secured at both the head end and the seat end, but short enough to keep the sling suspended above the chair frame. The gap between the sling and the surface of the chair frame creates a storage area.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

Figure 2:
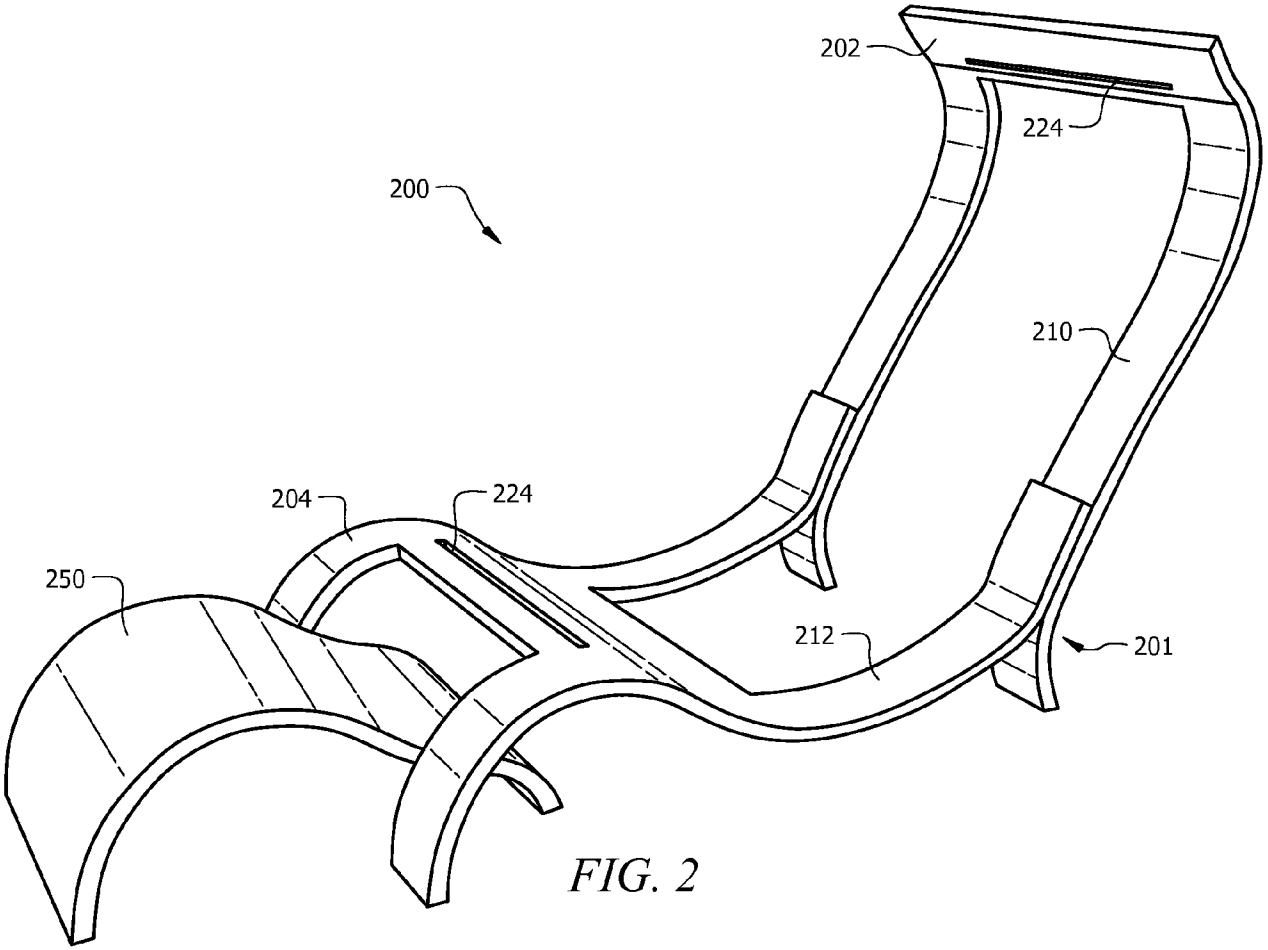
FIG. 2 is a perspective view of a second embodiment having an ottoman and lacking an attached sling.
Figure 3:
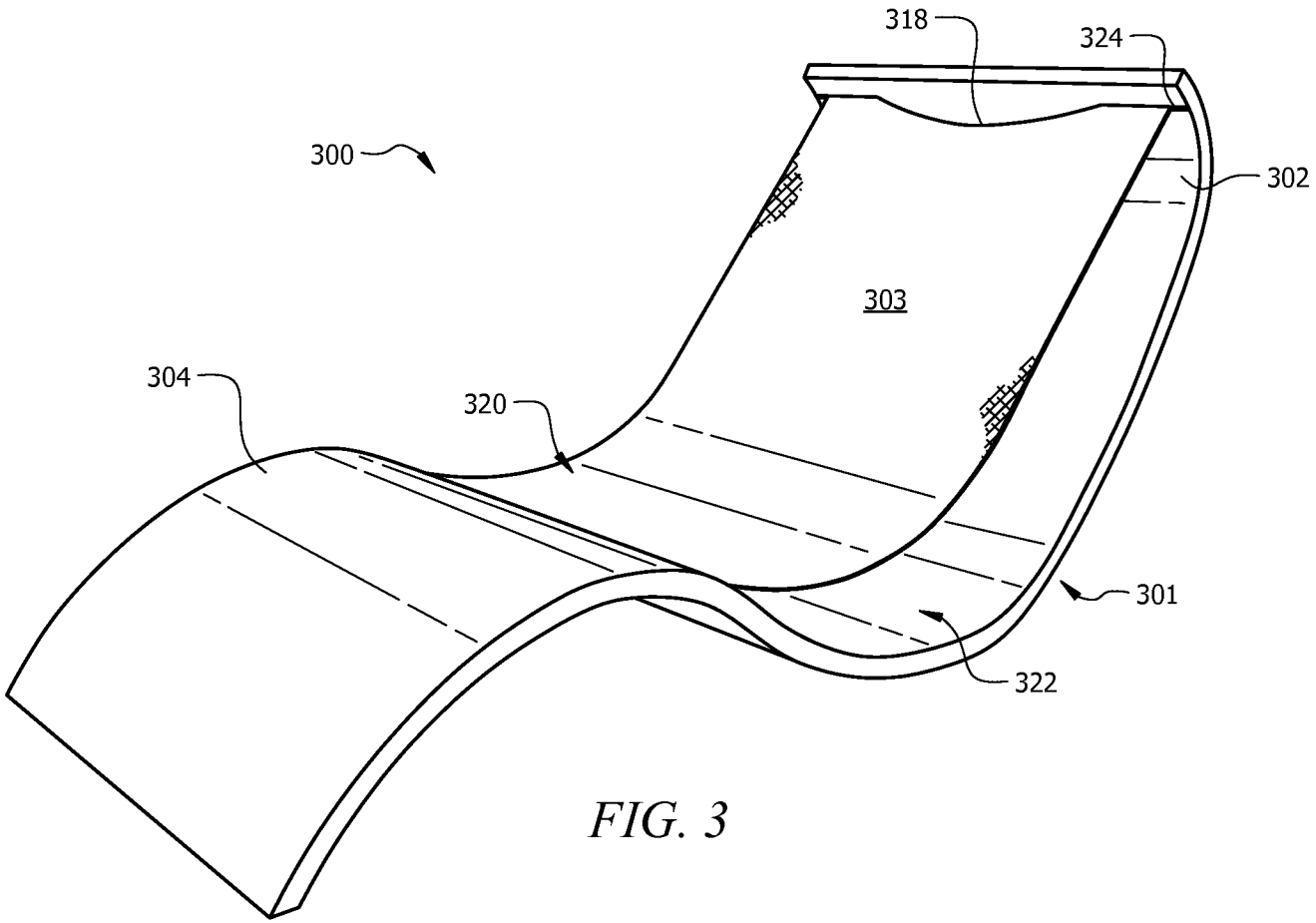
FIG. 3 is a perspective view of a third embodiment having a single frame design.

The present invention combines a chair frame with a fabric sling to create a sling sitting area that is elevated off the chair frame. The chair frame has a head end and a seat end, and the sling is extended between the head end and seat end of the chair frame. The chair frame can be a single frame, as shown in FIG. 3, or a combination of frames, as shown in FIGS. 1-2. FIGS. 1-2 only show a two frame design, but other embodiments may have a chair frame comprising of multiple smaller frames as determined by a person having ordinary skill in the art. The present invention contains slits disposed in the surface of the chair frame that allow for the passage of some portion of the sling. Excluding the slits, the frames may have a solid surface, as shown in FIGS. 1A-1E, or the frames may contain openings in the surface of the chair frame, as shown in FIG. 2. At least some portion of the frame has a solid surface, excluding the slits, to allow for the slit design.

The sling can be any material, color, and design, and have an adjustable length. The sling has a first end and a second end, where each end passes through the respective slits disposed in the surface of the chair frame. The ends of the sling pass through the surface of the chair frame facing the sitting area and protrude out of the surface of the chair frame facing away from the sitting area. The protruding ends of the sling are secured on the side of the chair opposite the sitting area. In a certain embodiment, the ends are secured without being affixed to the chair frame. One way this is achieved is by having eyeholes on the ends of the sling. A dowel can be disposed in the eyeholes that are protruding from the surface of the chair that is opposite the sitting area. As shown in FIGS. 1B and 1C, the dowel rests against the surface of the chair frame, but is not affixed to the chair frame. The dowel not being affixed to the chair frame aids in the ease of attachment, removal, and replacement of the sling, so that the user may easily and continually change the sling, giving the chair a new look. The sling may be secured without being affixed to the chair frame by other means known to persons having ordinary skill in the art.

The chair frame also provides for increased neck support not usually found in sling chairs. The head end of the chair frame contains a portion being concave or angled towards the sitting area with the slits being disposed in the concave portion. The concave feature allows the sling to attach in more of a vertical orientation, which would not be possible without the concave or angled design. Because of the vertical attachment and the concave portion of the head end, the user is provided with increased neck support, while also preventing the user's head from contacting the chair frame and thereby maintaining the desired suspended nature of the sling design.

In a certain embodiment the sling may include notches in the ends that reduce stretching, waving, and bunching of the fabric. A certain embodiment may also include the addition of accessories such as armrests (see FIG. 1E), footrest, ottomans (see FIG. 2), etc.

Example 1

Figure 1A:
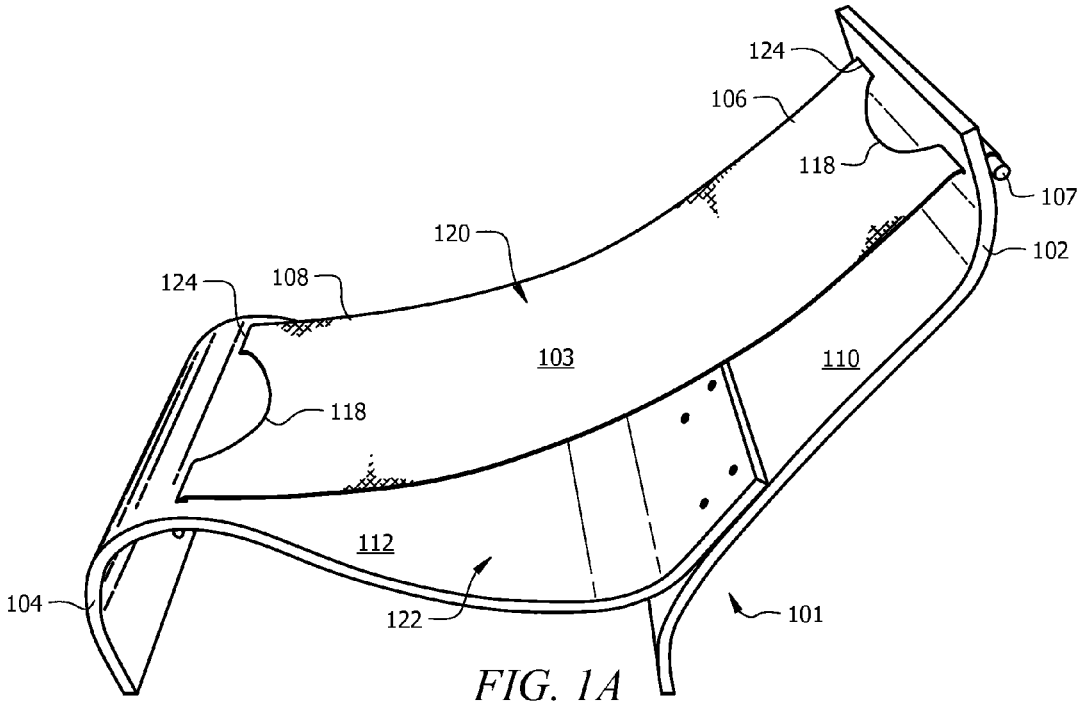
FIG. 1A is a perspective view of a first embodiment of the sling-back chair.
Figure 1B:
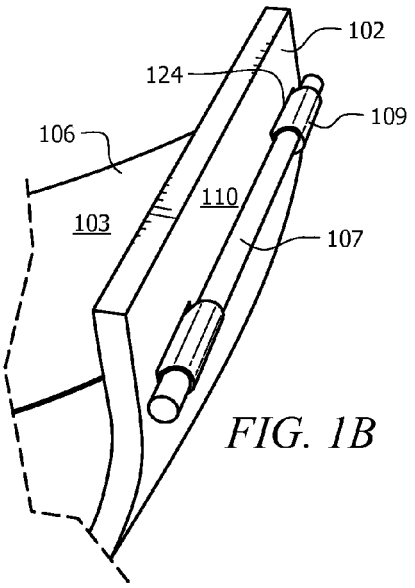
FIG. 1B is a close-up rear sectional view of the head end of the first embodiment.
Figure 1C:
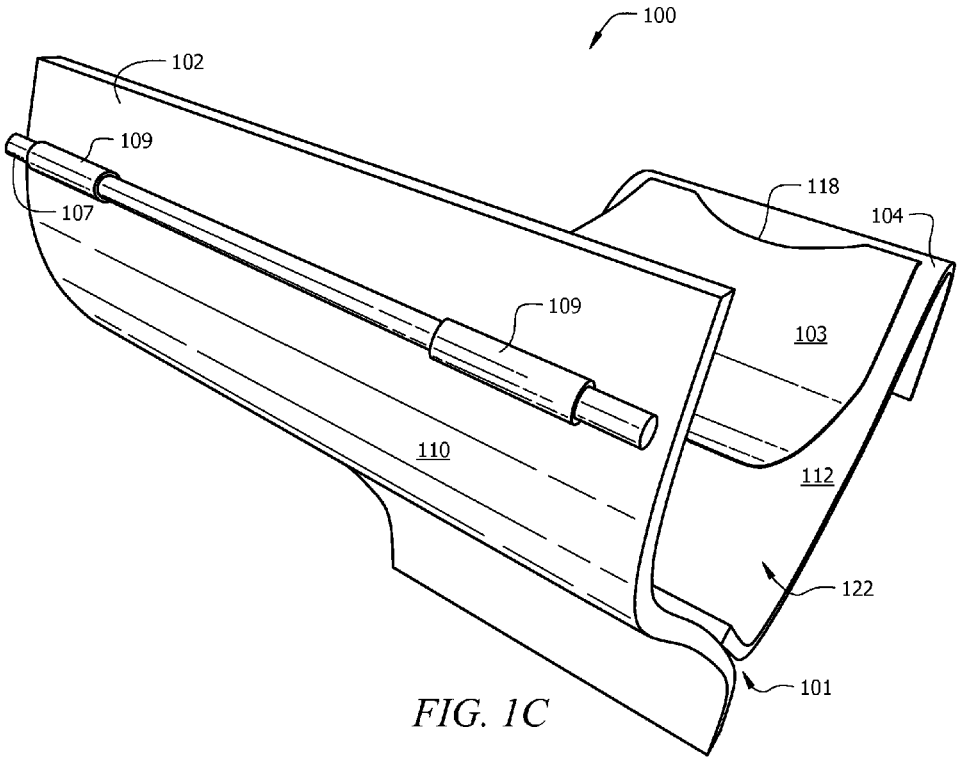
FIG. 1C is a rear perspective view of the first embodiment.
Figure 1D:
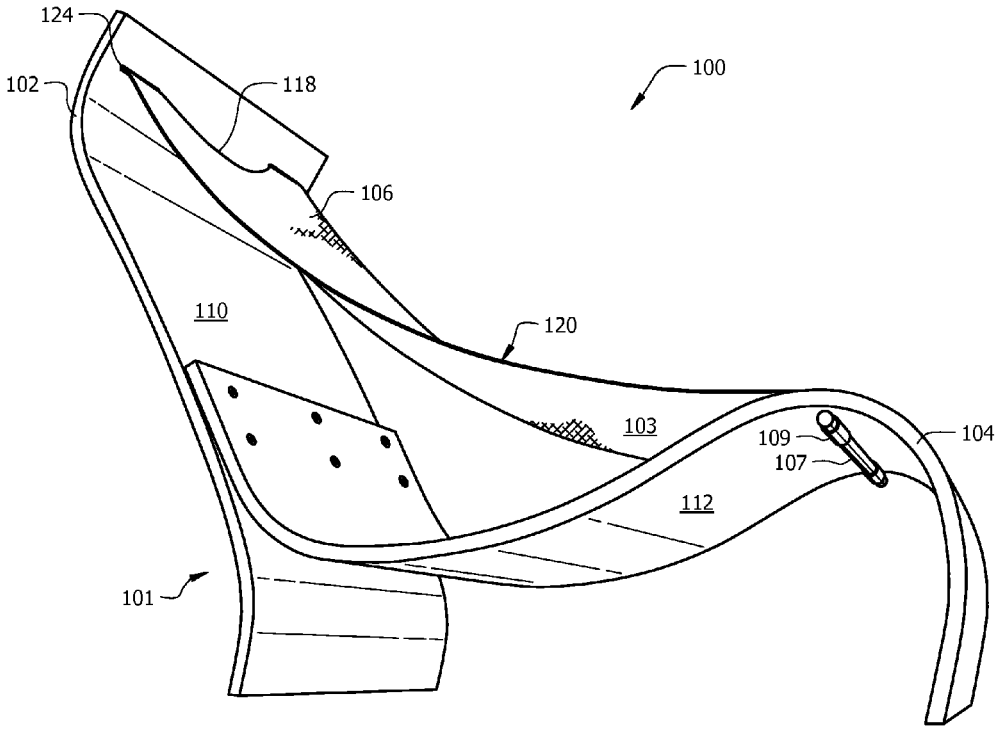
FIG. 1D is a bottom perspective view of the first embodiment.

As shown in FIG. 1A, a certain embodiment 100 has chair frame 101 being composed of seat frame 112, fastened to back frame 110. Back frame 110 has a generally upstanding configuration with a top and a bottom end. The top end is head end 102 of chair frame 101 and the bottom end is a point of contact with the ground. Head end 102 is concave towards sitting area 120 and contains at least one slit 124 through which some amount of sling 103 is capable of passing.

Seat frame 112 has a generally horizontal configuration with a proximal end and a distal end. The distal end is seat end 104 of back frame 101 and a point of contact with the ground. The proximal end is fastened to the back frame. Seat end 104 has at least one slit 124 through which some amount of sling 103 is capable of passing.

The shape of seat frame 112 is similar to the shape of back frame 110 so that frames 110, 112 can nest together when not attached to each other. This allows for more efficient inventory, storage and shipping. In another embodiment, back frame 110 and seat frame 112 have an identical shape.

As shown in FIG. 1A, embodiment 100 utilizes single fabric sling 103 having a length and a width, first end 106, and second end 108. First end 106 attaches at head end 102 and second end 108 attached at seat end 104. Each end of sling 103 has semicircular notch 118 roughly centered along a central transversal axis. The central transversal axis extends from first end 106 to second end 108, running through the midpoint of both ends 106, 108 of sling 103. The ends have at least some portion being perpendicular (perpendicular portion) 109 to the central transverse axis of sling 103 that is capable of passing through slits 124. Perpendicular portions 109 have eyeholes to allow for passage of dowel 107. Sling 103 is long enough to extend between head end 102 and seat end 104, but short enough to keep sling 103 suspended above chair frame 101, creating storage area 122 between chair frame 101 and sling 103.

Embodiment 100 contains two slits 124 in head end 102 and two slits 124 in seat end 104 to allow perpendicular portions 109 of sling 103 to enter through the surface of the chair frame facing sitting area 120 and protrude out of the surface facing away from sitting area 120. Dowel 107 is disposed in slits 124 to secure sling 103.

Figure 1E:
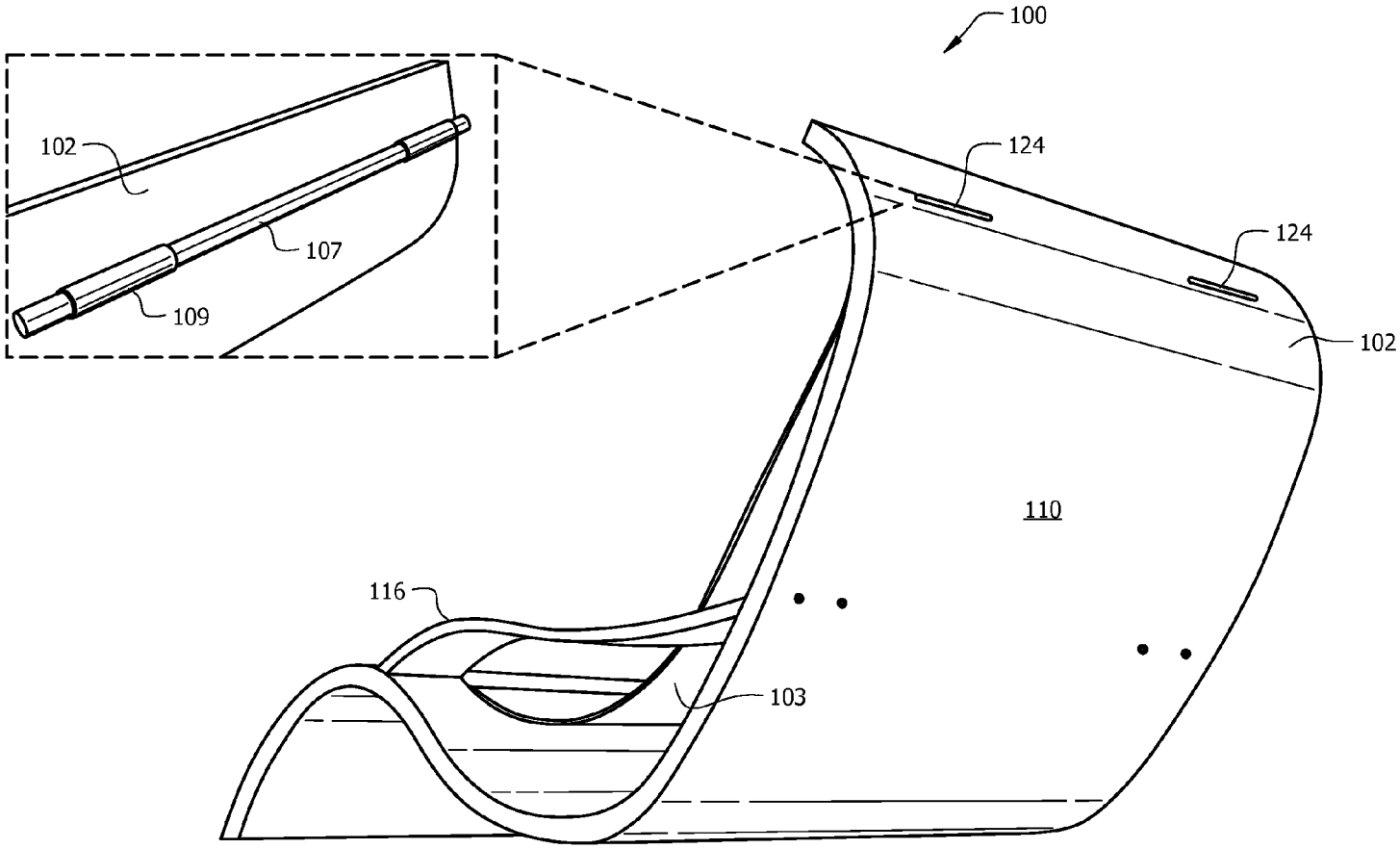
FIG. 1E is a rear perspective view of the first embodiment having an armrest and a pop-out sectional view of the head end of the first embodiment.

As shown in FIG. 1E, embodiment 100 is capable of receiving an armrest 116.

Example 2

As shown in FIG. 2, embodiment 200 has back frame 210 with a removed portion and seat frame 212 with a removed portion. The removed portions decrease the weight of the sling chair, allow for a lower sagging sling resulting in a different sitting orientation, and decrease the amount of materials used. Embodiment 200 also illustrates the inclusion of ottoman 250 having a similar curvature to chair frame 201. A portion of seat frame 212 is removed to allow a portion of ottoman 250 to be positioned under seat frame 212.

Embodiment 200 contains single slit 224 in head end 202 and single slit 224 in seat end 204. The single slit design allows a sling without a notch to pass through the frames.

Example 3

As shown in FIG. 3, embodiment 300 has single chair frame 301.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY

Armrest: is a support member disposed on the chair frame to support a user's arm.

Back Frame: is a part of the chair frame that would be the back support of the chair frame if the sling was removed.

Central Transversal Axis: is an axis extending from the first end of the sling to the second end of the sling running through the midpoint of both ends.

Chair Frame: is a basic rigid structure that supports the overall chair design.

Concave Portion: is a portion being angled or curved inward towards the sitting area. The portion can be circular or linear.

Footrest: is a support member disposed from the chair frame to support a user's legs.

Head End: is one of two ends of the chair frame that is roughly located where a user's head or back might rest.

Notch: is a cutout in an end of the sling.

Seat End: is one of two ends of the chair frame that is roughly located where a user's legs or buttock might rest.

Seat Frame: is a part of the chair frame that would be the seat of the chair frame if the sling was removed.

Sling: is a body of fabric or flexible material.

Slit: is an opening in the surface of the chair frame to allow passage of a portion of the sling through to the other surface of the chair frame.

What is claimed is:

1. A sling back chair, comprising:

a chair frame having an upper end, a lower end, a longitudinal axis extending between the upper and lower ends, an inward facing surface, and an outward facing surface;

a seat frame and a back frame, the seat frame having a generally horizontal configuration, the back frame having a generally upstanding configuration;

the seat frame further including a first end and a second end, the second end being the lower end of the chair frame and a point of contact with the ground, the first end connecting to the back frame;

the back frame further including a first end and a second, the first end being the head end of the chair frame and the second end being another point of contact with the ground;

the seat frame and back frame having a similar shape such that the back frame and seat frame may nest together when not attached to each other;

a sling having a first end, a second end, and a longitudinal axis extending between the first and second ends, the first end securable to the upper end of the chair frame and the second end securable to the lower end of the chair frame creating a sitting area between the first and second ends when the first and second ends are secured to the chair frame;

the upper end of the chair frame further including a slit disposed in the inward facing surface of the chair frame, the slit having a length that extends transversely with respect to a vertical plane in which the longitudinal axis of the sling resides, the slit having a size and shape such that it may receive a portion of the first end of the sling; and the lower end of the chair frame further including a slit disposed in the inward facing surface of the chair frame, the slit having a length that extends transversely with respect to the vertical plane in which the longitudinal axis of the sling resides, the slit having a size and shape such that it may receive a portion of the second end of the sling.

2. A sling chair according to claim 1, wherein the upper end further includes the slit located in a portion of the upper end that is concave towards the sitting area.

3. A sling chair according to claim 1, wherein the sling has a length extending between the first end and second end of the sling such that the sling is suspended above the chair frame when the first and second ends of the sling are secured to the chair frame resulting in a storage area between the chair frame and the sling.

4. A sling chair according to claim 1, wherein the sling is secured without being directly affixed to the chair frame.

5. A sling chair according to claim 4, further comprising:

an eyehole disposed on the first end of the sling and an eyehole disposed on the second end of the sling;

the slit creating a hole through both the inward facing and outward facing surfaces of the chair frame; and the sling being secured by a first dowel disposed in the eyehole on the first end of the sling when the eyehole is protruding from the outward facing surface of the chair frame and by a second dowel disposed in the eyehole on the second end of the sling when the eyehole is protruding from the outward facing surface of the chair frame.

6. A sling chair according to claim 1, further comprising a footrest.

7. A sling chair according to claim 1, further comprising an armrest extending from the upper end to the lower end of the chair frame.

8. A sling chair according to claim 1, wherein the first end of the sling includes a notch roughly centered along a central transversal axis and the second end includes a notch roughly centered along the central transversal axis, the first end further including a perpendicular portion with respect to the longitudinal axis of the sling, wherein the perpendicular section portion is capable of passing into the slit in the upper end of the chair frame, the second end further including a perpendicular portion with respect to the longitudinal axis of the sling, wherein the perpendicular section portion is capable of passing into the slit in the lower end of the chair frame.

9. A sling chair according to claim 8, wherein the perpendicular portions of both the first and second ends of the sling include an eyehole adapted to receive a dowel.

10. A sling back chair, comprising:

a chair frame, wherein the chair frame further includes:

an upper end, a lower end, and a longitudinal axis extending between the upper and lower ends;

an inward facing surface and an outward facing surface;

a seat frame and a back frame, the seat frame having a generally horizontal configuration, the back frame having a generally upstanding configuration;

the seat frame further including a first end and a second end, the second end being the lower end of the chair frame and a point of contact with the ground, the first end connecting to the back frame;

the back frame further including a first end and a second, the first end being the head end of the chair frame and the second end being another point of contact with the ground; and the seat frame and back frame having a similar shape such that the back frame and seat frame may nest together when not attached to each other;

a sling having a first end, a second end, and a longitudinal axis extending between the first and second ends, the first end securable to the upper end of the chair frame and the second end securable to the lower end of the chair frame creating a sitting area between the first and second ends when the first and second ends are secured to the chair frame;

the upper end of the chair frame further including a slit disposed in the inward facing surface of the chair frame, the slit having a size and shape such that it may receive a portion of the first end of the sling; and the lower end of the chair frame further including a slit disposed in the inward facing surface of the chair frame, the slit having a size and shape such that it may receive a portion of the second end of the sling.

11. A sling chair according to claim 10, wherein the upper end further includes the slit located in a portion of the upper end that is concave towards the sitting area.

12. A sling chair according to claim 10, wherein the sling has a length extending between the first end and second end of the sling that is short enough such that the sling is suspended above the underlying chair frame when the first and second ends of the sling are secured to the chair frame resulting in a storage area between the chair frame and the overlying sling.

13. A sling chair according to claim 10, wherein the sling is secured without being directly affixed to the chair frame.

14. A sling chair according to claim 13, further comprising:

an eyehole disposed on the first end of the sling and an eyehole disposed on the second end of the sling;

the slit creating a hole through both the inward facing and outward facing surfaces of the chair frame; and the sling being secured by a first dowel disposed in the eyehole on the first end of the sling when the eyehole is protruding from the outward facing surface of the chair frame and by at a second dowel disposed in the eyehole on the second end of the sling when the eyehole is protruding from the outward facing surface of the chair frame.

15. A sling chair according to claim 10, further comprising a footrest.

16. A sling chair according to claim 10, further comprising an armrest extending from the upper end to the lower end of the chair frame.

17. A sling chair according to claim 10, wherein the first end of the sling includes a notch roughly centered along a central transversal axis and the second end includes a notch roughly centered along the central transversal axis, the first end further including a perpendicular portion with respect to the longitudinal axis of the sling, wherein the perpendicular section portion is capable of passing into the slit in the upper end of the chair frame, the second end further including a perpendicular portion with respect to the longitudinal axis of the sling, wherein the perpendicular section portion is capable of passing into the slit in the lower end of the chair frame.

18. A sling chair according to claim 17, wherein the perpendicular portions of both the first and second ends of the sling include an eyehole adapted to receive a dowel.

19. A sling back chair, comprising:

a chair frame having an upper end, a lower end, a longitudinal axis extending between the upper and lower ends, an inward facing surface, and an outward facing surface;

a sling having a first end securable to the upper end of the chair frame and a second end securable to the lower end of the chair frame creating a sitting area between the first and second ends when the first and second ends are secured to the chair frame;

the upper end of the chair frame further including a slit disposed in the inward facing surface of the chair frame, the slit having a size and shape such that it may receive a portion of the first end of the sling;

the lower end of the chair frame further including a slit disposed in the inward facing surface of the chair frame, the slit having a size and shape such that it may receive a portion of the second end of the sling; and the first end of the sling includes a notch roughly centered along a central transversal axis and the second end includes a notch roughly centered along the central transversal axis, the first end further including a perpendicular portion with respect to a longitudinal axis of the sling, wherein the perpendicular section portion is capable of passing into the slit in the upper end of the chair frame, the second end further including a perpendicular portion with respect to the longitudinal axis of the sling, wherein the perpendicular section portion is capable of passing into the slit in the lower end of the chair frame.

* * * * *